United States Patent [19]

Kobayashi

[11] 4,228,843

[45] Oct. 21, 1980

[54] ROLL BLIND

[76] Inventor: Hitoshi Kobayashi, c/o Yokota Inc. of No. 7-2, 5-chome, Ueno, Taito-ku, Tokyo, Japan

[21] Appl. No.: 898,861

[22] Filed: Apr. 21, 1978

[30] Foreign Application Priority Data

May 7, 1977 [JP] Japan ..... 52-57862[U]

[51] Int. Cl.[2] ..... E06B 9/208

[52] U.S. Cl. ..... 160/306; 160/315

[58] Field of Search ..... 160/306, 315

[56] References Cited

U.S. PATENT DOCUMENTS

| | | | |
|---|---|---|---|
| 170,298 | 11/1875 | Pierce | 160/306 |
| 748,641 | 1/1904 | Newell | 160/315 |
| 809,098 | 1/1906 | Derby | 160/315 |
| 871,661 | 11/1907 | Arctander | 160/315 |
| 1,726,589 | 9/1929 | Schultes | 160/315 |
| 1,800,080 | 4/1931 | Kaminski et al. | 160/315 |

*Primary Examiner*—Peter M. Caun

*Attorney, Agent, or Firm*—McGlew and Tuttle

[57] ABSTRACT

Disclosed is a roll blind including a winder fitted around a pin of a roll which is on the side of rolling-in spring housed in the roll, in which one means is formed on the end of said roll and the other means is formed on said winder. After the spring is rolled in by the rotation of the winder, both means are coupled to each other by an engaging member so that the return of the winder is restrained.

6 Claims, 13 Drawing Figures

ROLL BLIND

BACKGROUND OF THE INVENTION

The present invention relates to a roll blind.

In order to mount a roll blind, sockets are secured in advance to the opposite ends of the upper side of a window frame. The end of the pin projecting from the right end of a screen body, i.e., a roll is inserted into the support hole of the right socket. The end of the pin protruding from the left end of the roll is then clamped and rotated with the use of a tool such as a pair of pincers, whereby a rolling-in spring is rolled in. Thereafter, the pin ends are fitted into the support holes by way of a groove communicating with said holes. The roll blind is mounted to the window frame in this manner; however, it is quite troublesome for amateurs, especially females and children to clamp and turn the pin end with the aid of a pair of pincers so as to roll in the spring and then, insert the pin ends into the sockets.

SUMMARY OF THE INVENTION

The present invention has been accomplished taking the aforesaid drawback into consideration, and has for its object to provide a screen body constructed in such a way that a winder is fitted around a pin of a roll which is on the side of a rolling-in spring housed in the roll and means being made to engage each other are formed on said winder and the end of said roll; said rolling-in spring being rolled in by said winder so that both means are coupled to each other by an engaging member. According to such a construction, the roll blind can be mounted to a window frame for immediate use by inserting supportably the right end of the pin into the support hole of one of the sockets mounted to the opposite ends of the upper side of the window frame, inserting supportably the left end of the pin into the support hole of the other socket and removing the engaging member from both means made to engage each other.

BRIEF DESCRIPTION OF THE DRAWINGS

The invention can be more fully understood from the following detailed description when taken in conjunction with the accompanying drawings, in which:

Referring now to FIGS. 1 through 5, a screen body is generally designated by numeral 1, and sockets for supporting the screen body 1 at its both ends are generally designated by 2a and 2b.

As shown in FIG. 1, the screen body 1 comprises a roll 3, a screen 4 and a pull 5. Pins 7a and 7b not shown are designed to project from the opposite ends of the roll 3 and are supportably inserted from the ends into the support holes of said pockets 2a and 2b through covers 6a and 6b; one pin 7a or 7b being fixed and the other pin 7b or 7a respectively connected integrally to the end of a winding shaft 10 provided with a clutch 9 for energizing a rolling-in spring 8 which is housed in the roll as shown in FIG. 2. The cover 6a, includes a centrally disposed aperture 20 that the cover 6a may be fitted onto the end of the roll 3 with the pin 7a, extending through the aperture 20. The cover 6a is provided on the periphery of its end with a means 11 made to engage a winder 12; said means comprising an inserting hole formed by protrusion from the inside, as depicted in FIG. 4. In a through hole 13, the winder 12, for turning the winding shaft 10, is fitted around the pin 7a. Although the winder may be formed of metal, it is preferably made of snythetic resin molded to a dish-like shape. As illustrated in FIG. 2 and 5, the winder has, transversely extending from a generally planar body, a rimmed edge 22, which is provided with a means 14 for engaging the means 11 (not shown in FIG. 5) through an engaging member 15, described hereinafter. In the embodiment illustrated in FIGS. 2 and 5, the means 14 includes rim passages extending through the rimmed edge 22 at diametrically opposite locations in alignment with each other; the means 14 also includes, as is best shown in FIG. 5, diametrical cutout grooves 16a, 16b, formed on the inner side 21 which communicate with the inserting hole defining said means 11 and holes or grooves 17a, 17b which extend obliquely, i.e., reach the ends of the opposite sides of the through hole 13. The through hole 13 is provided therearound with a projecting edge 18 projecting from the surface 21 having grooves 17a and 17b arranged one above another in its central portion. An engaging member 15, shown in FIG. 5 as a U-shaped pin will enter one of said grooves in 17a, 17b. The winder 12 is turned to rotate the winding shaft 10 so that the spring 8 is rolled in. In this state, the means 11 is coupled to the means 14 by inserting the engaging member 15 formed of a U-shaped pin into them, as clearly shown in FIG. 5. The U-shaped pin 15 is snap-fitted at one free end or leg into one groove 17a (FIG. 5) defined in the projecting edge 18. In the connection, 16a or 16b represent the grooves for receiving the other free end or leg of the U-shaped pin formed on the inner surface of the winder 12. In this connection, 16a and 16b represent the grooves passing through the means 14 formed adjacent the inner surface 21 of the winder 12. Reference will now be made to the mounting of the roll blind according to the aforesaid embodiment. The sockets 2a and 2b are firstly mounted to the upper right and left ends of a window frame. Next, the screen body 1 is supported by inserting one fixed pin 7b into the support hole of the socket 2b and then, inserting the other pin 7a into the support hole of the socket 2a through the upper communicating notch. The engaging member 15, i.e., the U-shaped pin is lastly removed by pulling out it by hand. Thereafter, the screen body can be rolled up and down by the manipulation of the pull 5.

Figure 1:
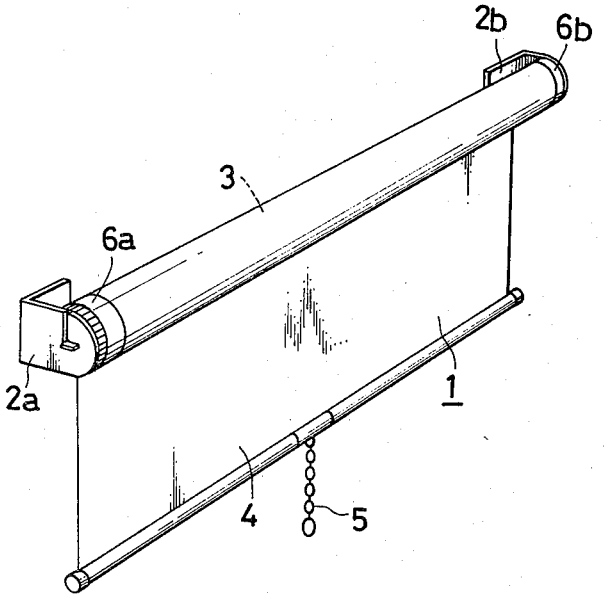
FIG. 1 is a perspective view of a first embodiment of the invention.
Figure 2:
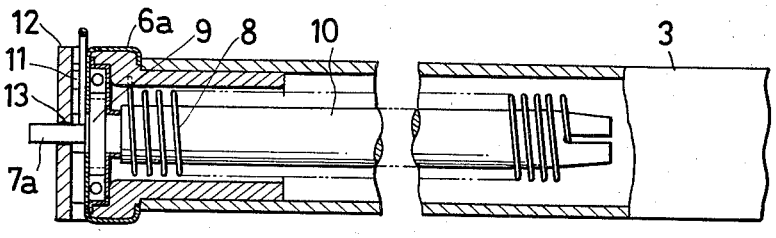
FIG. 2 is a longitudinally sectional view, partially cut away, of the first embodiment.
Figure 3:
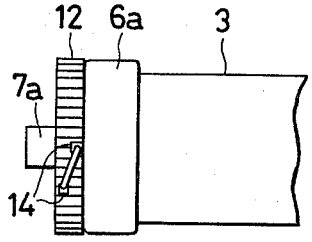
FIG. 3 is a plan view of FIG. 2.
Figure 4:
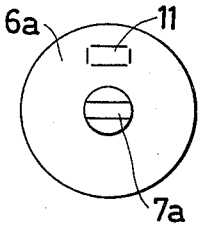
FIG. 4 is a side view showing a roll in the first embodiment.
Figure 5:
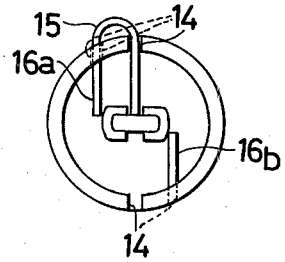
FIG. 5 is a side view, partly in section, illustrating a winder therein.

In accordance with the embodiment of the present invention as mentioned above, the means 11 is formed on the periphery of the end of the cover 6*a* fitted onto the end of the winding shaft 10 along which the spring 8 is rolled in. In the through hole 13, the winder 12 having the means 14 is fitted around the pin 7*a* projecting through aperture 20 in the cover 6*a*. The winder is turned to energize the winding shaft 10 by the action of the rolling-in spring 8. Thereafter, the means 11 is coupled to the means 14 by virtue of the engaging member 15. The thus constructed roll blind is supportably inserted into the sockets 2*a* and 2*b* mounted to the upper right and left ends of a window frame. The engaging member is lastly removed. Such a mounting operation is extremely convenient and is easily carried out in a home.

Figure 6:
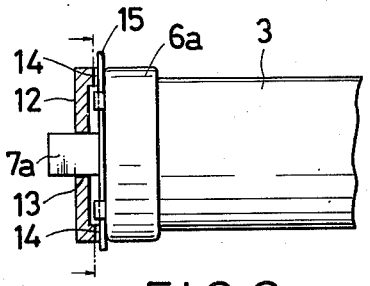
FIG. 6 is a partially cut away plan view illustrating the essential portion of a second embodiment.
Figure 7:
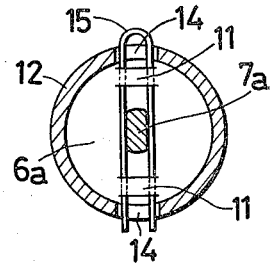
FIG. 7 is a side view taken along the line A—A of FIG. 6.

Explanation will now be made to other embodiments. Referring to FIGS. 6 and 7, the cover 6*a* for the roll 3 is provided on the upper and lower peripheries of its end with a means 11 made to engage the winder 12 in the longitudinal direction of the section of the pin 7*a;* said means comprising through holes formed by extrusion from the inside. On the other hand, the winder 12 is provided on the upper and lower inside edges of its periphery with a means 14 made to communicate with the means 11; said means comprising recessed notches. The winder 12 is turned to energize the winding shaft 10 by the action of the spring 8. Thereafter, the engaging member 15 formed of a U-shaped pin is inserted into the communicating holes of the means 11 on the side of the roll 3 and the means 14 on the side of the winder 12 astride the pin 7*a,* whereby the return of the spring 8 is restrained.

Figure 8:
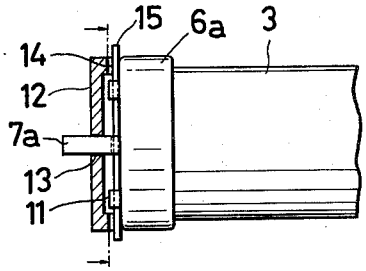
FIG. 8 is a partially cut away plan view illustrating the essential portion of a third embodiment.
Figure 9:
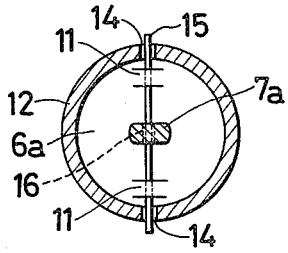
FIG. 9 is a side view taken along the line B—B of FIG. 8.

Referring to FIGS. 8 and 9, the cover 6*a* for the roll 3 is provided on the upper and lower peripheries of its end with a means 11 being made to engage the winder 12 in the direction perpendicular to the lateral direction of the section of the pin 7*a;* of winding the shaft 10 said means comprising through holes formed by extrusion from the inside. On the other hand, the winder 12 through which the pin 7*a* is inserted is provided on the upper and lower inside edges of its periphery with a means 14 being made to communicate with the means 11; said means comprising recessed notches. A through hole 16 is provided in the pin 7*a*. The winder 12 is turned to energize the winding shaft by the action of the rolling-in spring 8. Thereafter, the means 11 on the side of the roll 3, the means 14 on the side of the winder 12 and the through hole 16 in the pin 7*a* are permitted to communicate with one another. The engaging member 15 of a single straight pin is inserted into them, whereby they are supportably coupled to one another by the return force of the rolling-in spring 8.

Figure 10:
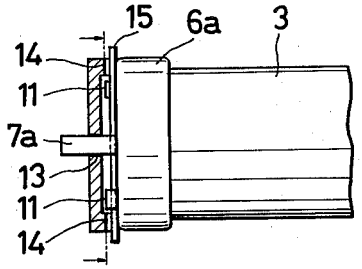
FIG. 10 is a partially cut away plan view depicting the essential portion of a fourth embodiment.
Figure 11:
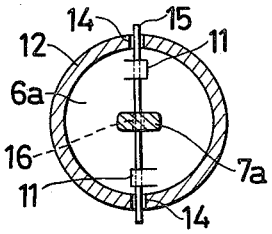
FIG. 11 is a side view taken along the line C—C of FIG. 10 thereof.

In accordance with an alternative embodiment illustrated in FIGS. 10 and 11, a means 11 comprises claws facing opposite directions, rather than the through holes as illustrated in FIGS. 8 and 9. The means 11 is coupled to the means 14 by an engaging member of a single pin due to the return force of the spring 8.

Figure 12:
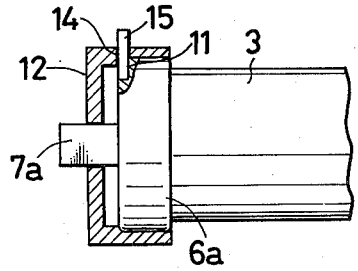
FIG. 12 is a partially cut away plan view depicting a fifth embodiment.
Figure 13:
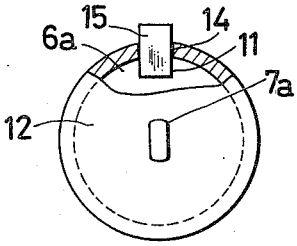
FIG. 13 is partially cut away side view thereof.

Referring to FIGS. 12 and 13, the cover 6*a* fitted onto the end of the roll is provided on the periphery of its end with a means 11 designed to engage the winder; said means comprising a groove. The winder 12 has a rimmed edge 22 transversely extending from a generally planar body, is designed to extend over the end of the roll 3, i.e., the cover 6*a,* and is provided on its periphery with a means 14 designed permit an engaging member to engage the cover 6*a;* said means comprising a through hole or rim passage. The engaging member 15 e.g. a pin, is inserted into the portion at which said means 11 and 14 are permitted to engage each other, whereby the return of the rolling-in spring 8 is restrained.

In accordance with any one of the foregoing embodiments, there are provided the means which engage the engaging member inserted therein to restrain the return of the winder when the winding shaft 10 is turned to energize the spring 8. That is to say, the foregoing embodiments give the same action and effect in the point that the pins 7*a* and 7*b* projecting from the opposite ends of the roll 3 having the winding shaft 10 energized by the rolling-in spring 8 are supportably inserted into the sockets 2*a* and 2*b* mounted to the both sides of the upper end of the window frame, whereby the screen can freely be rolled up and down, upon removal of the engaging member.

Accordingly, it is a further feature of the invention to provide a roll blind comprising an elongated cylindrical roll member having an internal chamber adjoining an open end of the roll member, a cover mounted on the open end of the roll member substantially closing the chamber and having a passage extending therethrough. A winding shaft rotatably mounted is rotatably mounted within the chamber and has a first and extending beyond the open end of the roll member and a second end disposed within the chamber. A pin is integrally connected to the first end of the winding shaft extending through the cover passage and spring means are disposed within the chamber connected to the rotatably mounted shaft and to the cover for energizing the winding shaft. A winder is operatively connected to the pin adjacent to the cover for winding the winding shaft and rolling-in in the spring means. An engaging member, means formed within the winder for receiving the engaging member and means formed within the cover also for receiving the engaging member permits a cover and the winder to be coupled together.

To those skilled in the art it will be obvious upon a study of this disclosure that the present invention permits a variety of modification in structure and arrangement and hence can be given embodiments other than particularly illustrated and described herein, without departing from the essential features of the invention within the scope of the claims annexed thereto.

What is claim is:

1. A roll blind comprising an elongated cylindrical roll member having an open end and an internal chamber adjacent to said open end, a winding shaft rotatably mounted within said chamber having an end portion extending beyond said open end, spring means disposed within said chamber connected between said winding shaft and said roll member for rotating said roll member relative to said winding shaft, a winder disposed adjacent to said open end and operatively connected to said end portion for winding said winding shaft and tensioning said spring means, engaging means engageable with said roll member and said winder for preventing relative rotation between said winder and said roll member, said engaging means being withdrawable from said winder and said roll member to permit relative motion therebetween, and said winder including a substantially planar body and a rimmed edge transversely extending from a side of said body disposed adjacent to said open end, and means formed within said body for receiving said engaging means including rim passages extending through said rimmed edge at oppositely disposed locations.

2. A roll blind according to claim 1, wherein said roll member includes means formed on said open end for receiving said engaging means having a member extending from a surface of said open end adjacent to said winder, said member including a notched portion for receiving said engaging means.

3. A roll blind according to claim 2, wherein said engaging means is a U-shaped pin.

4. A roll blind according to claim 1, wherein said means formed on said open end for receiving said engaging means include claws formed on the surface of said member adjacent to said winder.

5. A roll blind according to claim 4, wherein said engaging means is a straight pin.

6. A roll blind comprising an elongated cylindrical roll member having an open end and an internal chamber adjacent to said open end, a winding shaft rotatably mounted within said chamber having an end portion extending beyond said open end, spring means disposed between said chamber connected between said winding shaft and said roll member for rotating said roll member relative to said winding shaft, a winder disposed adjacent to said open end and operatively connected to said end portion for winding said winding shaft and tensioning said spring means, engaging means engageable with said roll member and said winder for preventing relative rotation between said winder and said roll member, said engaging means being withdrawable from said winder and said roll member to permit relative motion therebetween, and said winder having a generally planar body and a rimmed edge transversely extending from a side of said body disposed adjacent to said open end, said rim extending over said open end, and means formed within said body for receiving said engaging means including a rim passage extending through said rimmed edge and means formed on said open end for receiving said engaging means including a groove formed on said cover.

* * * * *